US006907853B2

(12) United States Patent
Noguchi

(10) Patent No.: US 6,907,853 B2
(45) Date of Patent: Jun. 21, 2005

(54) VARIABLE VALVE TIMING CONTROL DEVICE

(75) Inventor: Yuji Noguchi, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/205,396

(22) Filed: Jul. 26, 2002

(65) Prior Publication Data

US 2003/0029400 A1 Feb. 13, 2003

(30) Foreign Application Priority Data

Jul. 31, 2001 (JP) ..... 2001-230790

(51) Int. Cl.[7] ..... F01L 1/34

(52) U.S. Cl. ..... 123/90.17; 123/90.15; 74/568 R

(58) Field of Search ..... 123/90.15–90.18, 123/90.31; 74/568 R; 464/1, 2, 160; 92/121, 122

(56) References Cited

U.S. PATENT DOCUMENTS 5,836,276 A * 11/1998 Iwasaki et al. ..... 123/90.17
5,836,277 A * 11/1998 Kira et al. ..... 123/90.17
5,865,151 A * 2/1999 Fukaya et al. ..... 123/90.17
5,941,203 A * 8/1999 Sato ..... 123/90.17
6,006,709 A * 12/1999 Ushida ..... 123/90.17
6,024,061 A * 2/2000 Adachi et al. ..... 123/90.17
6,024,062 A * 2/2000 Kako et al. ..... 123/90.17
6,026,772 A * 2/2000 Shirabe ..... 123/90.17

FOREIGN PATENT DOCUMENTS

JP 2001-3716 A 1/2001

* cited by examiner

*Primary Examiner*—Thomas Denion
*Assistant Examiner*—Jaime Corrigan
(74) *Attorney, Agent, or Firm*—Burns, Doane, Swecker & Mathis, L.L.P.

(57) ABSTRACT

A variable valve timing control device includes a housing, a rotor at least one shoe portion dividing a fluid pressure chamber provided between the housing and the rotor, a plate member closing one axial end surface of the housing, plural fixing members for unitarily fixing the housing and the plate member, a vane dividing the fluid pressure chamber into an advance angle chamber and a retarded angle chamber, a lock plate provided on the rotor or the housing, an engagement groove provided on the other of the rotor and the housing for engaging the lock plate, and a relative rotation control mechanism provided on the one of the housing and the rotor. One of the fixing members is provided between one of the fluid pressure chambers and the relative rotation control mechanism and another fixing member is provided between the relative rotation control mechanism and another fluid pressure chamber.

14 Claims, 5 Drawing Sheets

VARIABLE VALVE TIMING CONTROL DEVICE

This application is based on and claims priority under 35 U.S.C. § 119 with respect to Japanese Application No. 2001-230790 filed on Jul. 31, 2001, the entire content of which is incorporated herein by reference.

FIELD OF THE INVENTION

This invention generally relates to a variable valve timing control device. More particularly, the present invention pertains to a variable valve control device for controlling the opening and closing timing of a valve of an internal combustion.

BACKGROUND OF THE INVENTION

A known variable valve timing control device is disclosed in Japanese Patent Laid-Open Publication No. 2001-3716. This known variable valve timing control device includes a first rotational body rotatably provided on a camshaft actuated being synchronized with the engine revolution and having a case provided with plural shoes on an internal peripheral surface, a second rotational body fixedly connected to the camshaft for slidably contacting an internal surface of the first rotational body and having a lock groove in axial direction on the sliding surface side, a lock member for locking the first rotational body and the second rotational body for unitary rotation by engaging with the lock groove and for releasing the lock by retracting from the lock groove, a biasing means for biasing the lock member towards the lock groove, and a hydraulic pressure supply means for applying the hydraulic pressure in the direction against the biasing force of the biasing means to the lock member. This variable valve timing control device further includes an engagement groove provided on at least one of the shoes in axial direction for retracting and supporting the lock member. At least one axial end of the groove is open. The side of the engagement groove facing the sliding surface of the second rotational body is open. The variable valve timing control device still further includes a plate shape lock member fitted in the engagement groove for sliding in the direction of the rotational center of the first and second rotational body, and a lock groove provided on a portion of a boss portion external peripheral surface of the second rotational body to be engaged with a tip portion of the plate shape lock member.

With respect to the known variable valve timing control device of the Japanese Patent Laid-Open Publication No. 2001-3716, the engagement groove is penetrated into at least one of the shoes of the case along the axial direction.

In the known variable valve timing control device of the Japanese Patent Laid-Open Publication No. 2001-3716, the first rotational body and the second rotational body are synchronized with each other to be rotated by the engagement of the lock member of the lock mechanism with a lock hole. In general, a cam provided on the camshaft of the internal combustion pushes down a valve body against the biasing force of the biasing means for biasing either an intake valve or an exhaust valve of the internal combustion engine (i.e., hereinafter referred as valve body) in closing direction. That is, the resistance applied to the cam when opening the valve body is large, and the resistance applied to the cam when closing the cam is small. Thus, the rotational speed of the camshaft is fluctuated relative to the rotational speed of the first rotational body (e.g., a timing pulley transmitted with the rotational force from a crankshaft via a belt) which rotates being synchronized with the engine revolution. More practically, the rotational speed of the camshaft is declined relative to the rotational speed of the first rotational body when the valve body is opened (i.e., when the cam is at a predetermined first phase). The rotational speed of the camshaft is increased relative to the rotational speed of the pulley when the valve body is closed (i.e., when the cam is at a predetermined second phase). By the change of the rotational speed in accordance with the rotational phase of the camshaft, the force for advancing or delaying the second rotational body (e.g., a rotor having a vane) relative to the rotation of the first rotational body is applied. The force applied to the second rotational body is also applied to the first rotational body via a lock portion for engaging the first rotational body and the second rotational body to be unitary rotated. In the known variable valve timing control device of the Japanese Patent Laid-Open Publication No. 2001-3716, the engagement groove engaged with the lock member is formed on one of the shoes formed on the case. The stress is repeatedly applied to the shoe portion including the engagement groove by the force for delaying and advancing the second rotational body relative to the first rotational body. Thus, it is required to ensure the strength of the portion around the engagement groove provided on the first rotational body. Notwithstanding, when reducing the size of the variable valve timing control device while managing to ensure the operation angle, it is difficult to ensure the strength of the shoe portion because the size of the shoe portion, particularly, the circumferential length is limited. In particular, provided that the engagement groove is provided on at least one of the shoes of the case along the axial direction, the shoe portion provided with the engagement groove has a structure like a cantilever, which may drastically decline the strength of the shoe portion.

A need thus exists for a variable valve timing control device which prevents the concentration of the load to a particular shoe portion for ensuring the strength thereof.

SUMMARY OF THE INVENTION

A variable valve timing control device includes a housing unitary rotating either one of a crankshaft or a camshaft of an internal combustion engine, a rotor unitary rotating with the other of the crankshaft or the camshaft of the internal combustion engine, at least one shoe portion for dividing a fluid pressure chamber provided between the housing and the rotor in a circumferential direction of the housing, a plate member for closing at least one of axial end surfaces of the housing, a plural fixing members for unitary fixing the housing and the plate member, a vane for dividing the fluid pressure chamber into an advance angle chamber and a retarded angle chamber, a lock plate provided on one of the rotor and the housing and movable in a radial direction of the rotor, an engagement groove provided on the other of the rotor and the housing for engaging with the lock plate, and a relative rotation control mechanism provided on said one of the housing and the rotor and including a retraction groove for moving the lock plate in radial direction for restricting a relative rotation between the housing and the rotor by an engagement of the lock plate with the engagement groove in accordance with a supply of fluid. One of the fixing members is provided between one of the fluid pressure chambers divided by the shoe portion and the relative rotation control mechanism and another fixing member is provided between the relative rotation control mechanism and another fluid pressure chamber.

BRIEF DESCRIPTION OF THE DRAWINGS

The foregoing and additional features and characteristics of the present invention will become more apparent from the following detailed description considered with reference to the accompanying drawing figures in which like reference numerals designate like elements.

DETAILED DESCRIPTION OF PREFERRED EMBODIMENTS

Figure 1:
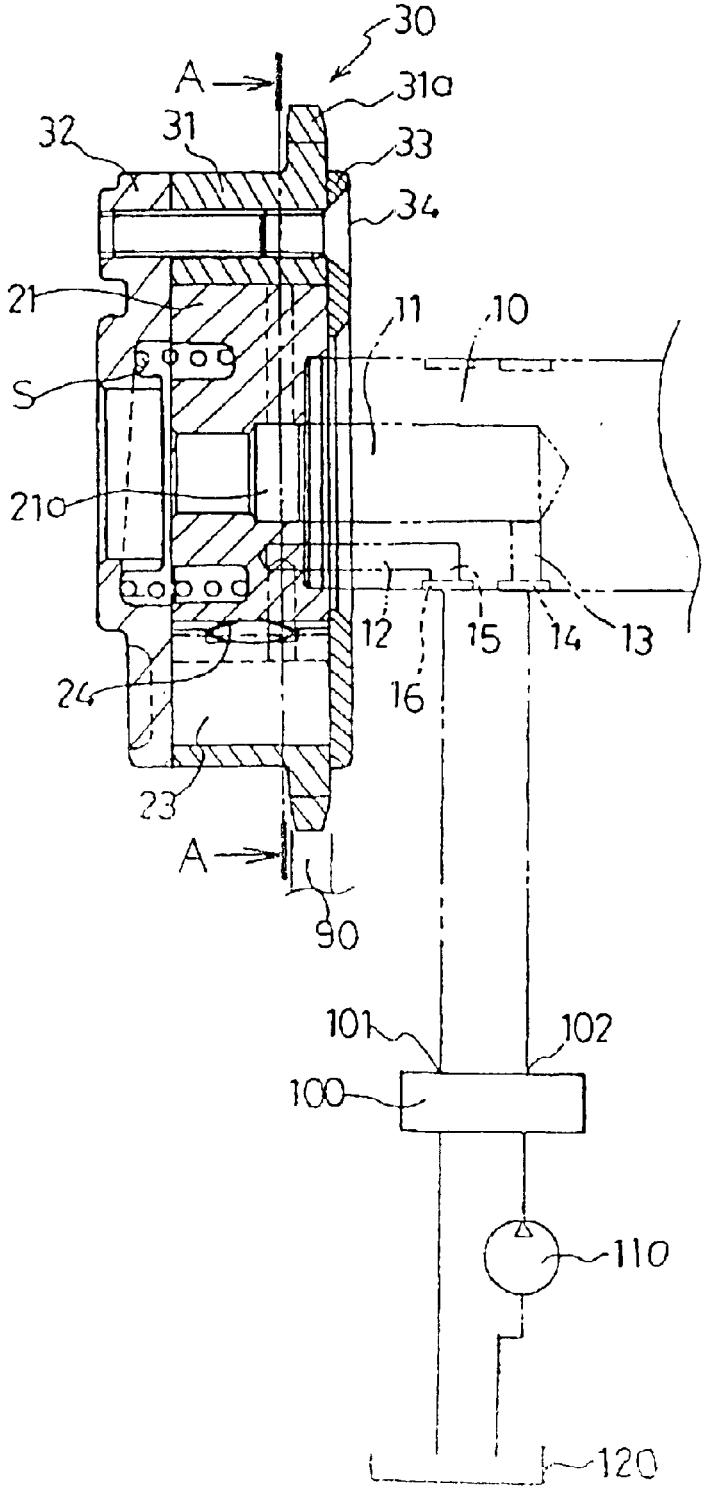
FIG. 1 is a cross-sectional view of a variable valve timing control device of a first embodiment of the present invention.

A first embodiment of a variable valve timing control device of the present invention will be explained referring to FIGS. 1–2. In order to reduce the complication of the drawing, the hatched line of FIG. 2 is omitted.

Figure 2:
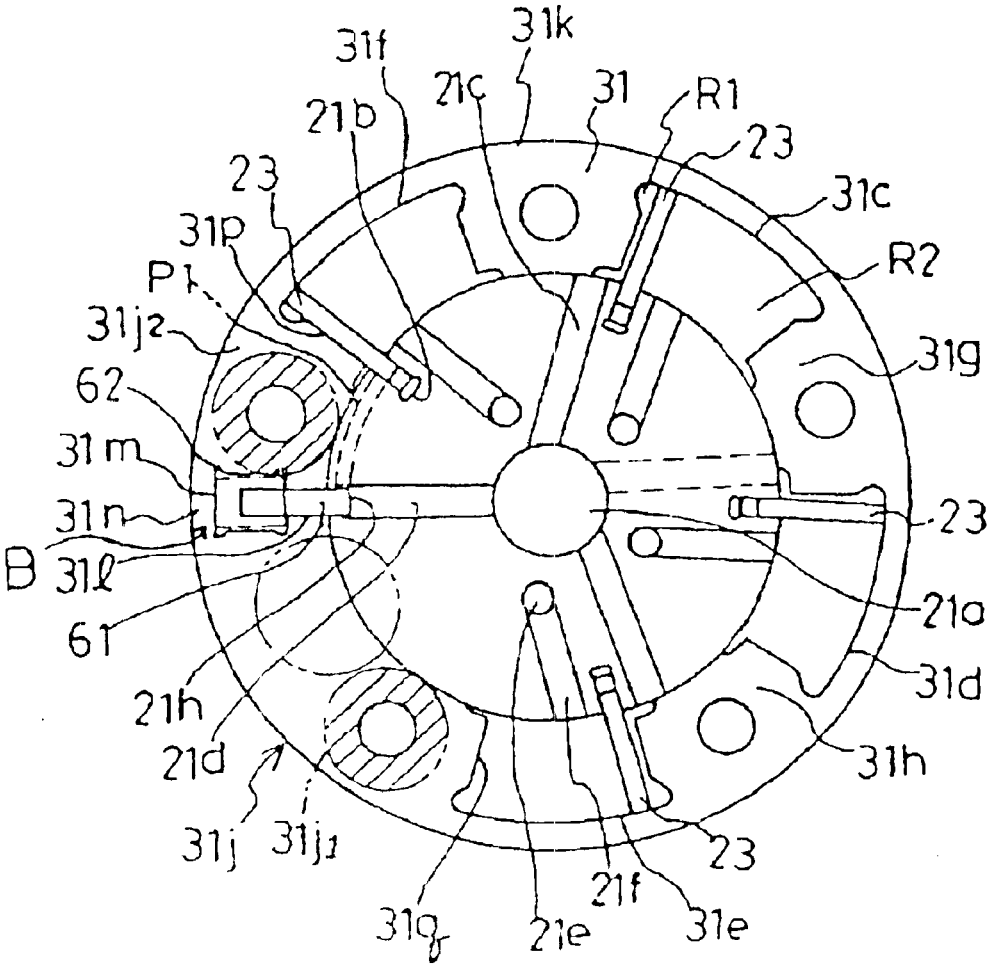
FIG. 2 is a cross-sectional view of the variable valve timing control device of FIG. 1 take on line A—A.

The variable valve timing control device of the present invention shown in FIGS. 1–2 includes a rotor 21 unitary assemble to a tip portion (i.e., shown in left end of FIG. 1) of a camshaft (i.e., driven shaft) 10 with bolts (not shown), a housing 30 outfitted to the rotor 21 to be rotatable relative to the rotor 21 for being transmitted with the rotational force from a crankshaft (i.e., rotation shaft; not shown) of an engine via a transmission member 90 (i.e., timing chain in this embodiment), a torsion spring S provided between the housing 30 and the rotor 21, and a hydraulic pressure control valve 100 for controlling the supply and discharge of the operation fluid (i.e., fluid) to/from a relative rotation control mechanism B (shown in FIG. 2) which controls the relative rotation between the housing 30 and the rotor 21 and the supply and discharge of the operation fluid to/from an advance angle chamber R1 and a retarded angle chamber R2. The hydraulic pressure control valve 100 also controls the supply and discharge of the operation fluid to/from the relative rotation control mechanism B.

The camshaft 10 includes a cam (not shown) for opening and closing one of an intake valve or an exhaust valve (not shown) and is rotatably supported by a cylinder head (not shown) of the internal combustion engine. An advance angle passage 11 and a retarded angle passage 12 extended in axial direction of the camshaft 10 is provided in the camshaft 10. The advance angle passage 11 is connected to a connection port 102 of the hydraulic pressure control valve 100 via a bore 13 in radial direction and an annular passage 14. The retarded angle path 12 is connected to a connection port 101 of the hydraulic pressure control valve 100 via a bore 15 in radial direction and an annular passage 16. The bores 13, 15 in radial direction and the annular passages 14, 16 are formed on the camshaft 10.

The rotor 21 unitary screwed to a tip portion of the camshaft 10 with bolts (not shown) includes a central inner bore 21*a* of the rotor 21 whose front end is closed with a head portion of the bolt. The central inner bore 21*a* is in communication with the advance angle path 11 provided on the camshaft 10.

The rotor 21 includes four vanes 23 (shown in FIG. 2) and vane grooves 21*b* (shown in FIG. 2) being assembled with springs 24 respectively for biasing the vanes 23 in radial direction. Each vane 23 is assembled in the corresponding vane groove 21*b* to be extended in the outer radial direction for dividing a fluid pressure chamber to form an advance angle chamber R1 and a retarded angle chamber R2.

The housing 30 includes a housing body 31, a front plate 32, a rear thin plate 33, and five bolts 34 for unitary connecting the housing body 31, the front plate 32, and the rear thin plate.

A sprocket 31*a* is unitary formed on a rear external periphery of the housing body 31. The sprocket 31*a* is connected to the crankshaft of the engine via the timing chain 90. The housing 30 is rotated in the clockwise direction of FIG. 2 by the transmission of the driving force from the crankshaft.

The housing body 31 includes four shoe portions 31*g*, 31*h*, 31*j*, 31*k* for forming four fluid pressure chambers (i.e., a first fluid pressure camber 31*c*, a second fluid pressure chamber 31*d*, a third fluid pressure chamber 31*e*, and a fourth fluid pressure chamber 31*f*). The fluid pressure chambers 31*c*, 31*d*, 31*e*, 31*f* are projecting in radial inner direction. More practically, the first fluid pressure chamber 31*c* is divided by the shoe portion 31*g* and the shoe portion 31*k*. The second fluid pressure chamber 31*d* is divided by the shoe portion 31*g* and the shoe portion 31*h*. The third pressure chamber 31*e* is formed by the shoe portion 31*h* and the shoe portion 31*j*. The fourth fluid pressure chamber 31*f* is divided by the shoe portion 31*j* and the shoe portion 31*k*. By positioning the vanes 23 in the corresponding four fluid pressure chambers 31*c*, 31*d*, 31*e*, 31*f*, respectively, the advance angle chamber R1 and the retarded angle chamber R2 are divided in each fluid pressure chamber.

The relative rotation control mechanism B is formed on the shoe portion 31*j*. The relative rotation control mechanism B allows the relative rotation between the housing 30 and the rotor 21 by the unlock operation by the supply of the operation fluid from the advance angle passage 11 and restricts the relative rotation between the housing 30 and the rotor 21 towards the advanced angle side at a most retarded angle phase position (i.e., the condition shown in FIG. 2) by the lock operation by the discharge of the operation fluid to the advanced angle passage 11. The relative rotation control mechanism B includes a lock plate 61, a lock spring 62, a lock groove 21*h*, a retraction bore 31*l*, and an accommodation portion 31*m*.

The slit shaped retraction bore 31*l* and the rectangular accommodation portion 31*m* whose width is wider than the retraction bore 31*l* are provided on the shoe portion 31*j* of the housing body 31. The lock plate 61 is assembled on the retraction bore 31*l* being slidable in the radial direction. The lock spring 62 for biasing the lock plate 61 to be projected from the retraction bore 31*l* is placed in the accommodation portion 31*m*.

A tip portion (i.e., internal diameter side end portion) of the lock plate 61 is slidably advancing to and retracting from the lock groove 21*h* provided on the rotor 21. The lock plate 61 is retracted to be accommodated in the retraction bore 31*l* by moving in the radial direction against the biasing force of the lock spring 62 by the supply of the operation fluid to the lock groove 21*h*. As shown in FIG. 2, the lock groove 21*h* is provided to face with the end portion (i.e., internal radial side end portion) of the lock groove 21*h* to each retraction bore 31*l* when the rotor 21 is at the most retarded angle phase position relative to the housing 30.

Because the retraction bore 31*l* and the accommodation portion 31*m* have the openings on the both sides in the central axial direction of the hosing body 31, a portion 31*j*1 of the shoe portion 31*j* closer to the third fluid pressure chamber 31*e* and a portion 31*j*2 of the shoe portion 31*j* closer to the fourth fluid pressure chamber 31*f* are connected via a peripheral portion 31*n* of the housing body 31.

Figure 3:
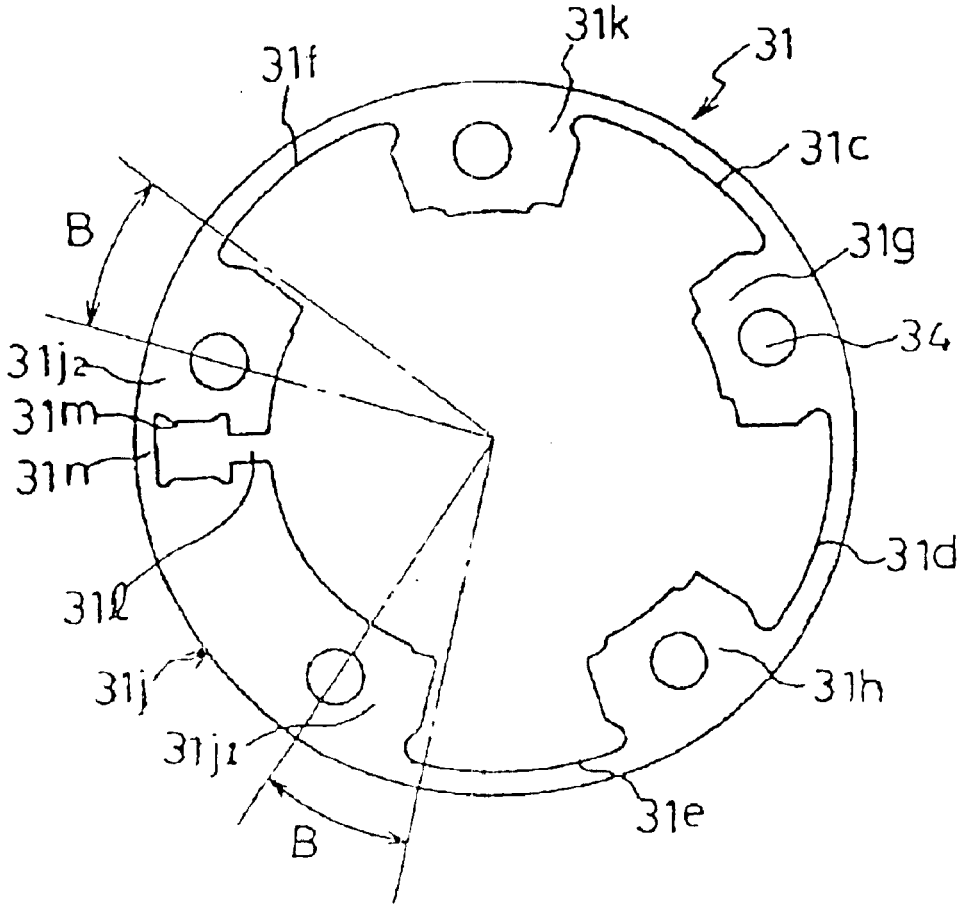
FIG. 3 is a view showing a housing of the variable valve timing control device of the first embodiment of the present invention.

Five bolts 34 for fixing the housing 30 are placed on each shoe portion 31*g*, 31*h*, 31*j*, 31*k*. Three bolts 34 are respectively positioned on the shoe portions 31*g*, 31*h*, 31*k* which are positioned between the fluid pressure chambers (e.g., the shoe portion 31*g* is positioned between the first fluid pressure chamber 31*c* and the second fluid pressure chamber 31*d*). Two bolts 34 are positioned on the shoe portion 31*j* on which the retraction bore 311 and the accommodation portion 31*m* are constructed. In this case, one bolt 34 of the two is positioned on the portion 31*j*1 and the other bolt 34 is portioned on the portion 31*j*2 for positioning the retraction bore 31*l* and the accommodation portion 31*m* between the bolts 34. According to the first embodiment, five bolts 34 are equally positioned in peripheral direction each having 72 degree interval with the neighboring bolt relative to the center of the hosing body 31. It is preferable that the two bolts 34 positioned on the portion 31*j*1 and the portion 31*j*2 are arranged to have the same angle B (shown in FIG. 3) relative to projections 31*p*, 31*q* respectively. Thus, a variable valve timing control device which operates the relative rotation control mechanism B when the relative phase between the housing 30 and the rotor 21 is at a most advance angle phase position can be constructed using the housing the same with the case that the relative rotation control mechanism B is operated when the relative phase between the lousing 30 and the rotor 21 is at the most retarded position. In this case, the same housing 30 is used by placing in reverse.

The torsion spring S provided between the housing 30 and the rotor 21 biases the rotation of the rotor 21 towards the advance angle side relative to the housing 30. By using the torsion spring S, the operational response when changing the relative rotational phase of the rotor 21 relative to the housing 30 from the retarded angle side to the advanced angle side is improved.

The hydraulic pressure control valve 100 corresponds to a variable type electromagnetic spool valve. The hydraulic pressure control valve 100 includes a solenoid, a spool, and a spring, for moving the spool against the biasing force of the spring by the energization to the solenoid. By performing duty cycle control regarding the energization amount to the solenoid, the stroke amount of tile spool is changed, thus to control the supply and discharge of the operation fluid to/from the advance angle passage 11, the retarded angle passage 12, and the first control mechanism B1.

The engine includes a hydraulic pressure circuit C having an oil pump 110, an oil pan 120, a supply passage, and a discharge passage. The operation fluid supplied to the advance angle chamber R1, the retarded angle chamber R2 and the relative rotation control mechanism B is supplied by the oil pump 110 actuated by the engine via the supply passage and the hydraulic pressure control valve 100. The operation fluid discharged from the advance angle camber R1, the retarded angle chamber R2 and the relative rotation control mechanism B reaches the oil pan 120 via the discharge passage and the hydraulic pressure control valve 100.

The operation of the variable valve timing control device will be explained as follows.

When the relative rotation control mechanism B of the variable valve timing control device 1 is operated, the lock plate 61 is engaged with the lock groove 21*h*. The fluctuation torque is applied to the camshaft 10 of the internal combustion engine under this condition. The fluctuation torque functions as the force for alternately rotating the camshaft 10 in the advanced angle direction and in the retarded angle direction. The rotor 21 is also alternately rotated in the advance angle direction and the retarded angle direction because the rotor 21 is fixed to the camshaft 10 to be unitary rotated.

When the internal combustion engine is stopped, the operation fluid is returned to the oil pan 12 from each advance angle chamber R1, each retarded angle chamber R2, and the lock groove 21 of the relative rotation control mechanism B through the clearance of each member.

The operation fluid cannot be sufficiently discharged even if the oil pump 110 is actuated by the internal combustion engine at the initial phase immediately after the engine start, particularly, during warming up the engine. The insufficient discharge of the operation fluid when the oil pump 110 is actuated by the internal combustion engine during the engine warming up is caused by an unstable operation of the internal combustion engine immediately after the start of the engine. The insufficient discharge of the operation fluid at the initial stage of the engine start also derives from the increased discharge pressure and the small operation fluid volume because the operation fluid discharged from the oil pump 110, for example, the engine oil used for lubricating the internal combustion engine includes high viscosity under the low temperature. Thus, the operation fluid cannot be sufficiently supplied from the hydraulic pressure circuit C to each advance angle chamber R1 and each retarded angle chamber R2 respectively even when the hydraulic pressure control valve 100 is controlled. In this case, the relative rotational position of the rotor 21 relative to the housing 30 is not maintained by applying the fluid pressure in the advance angle chamber R1 to the vane 23, instead, the relative rotational position of the rotor 21 relative to the hosing 30 is maintained at the most retarded angle phase position by the relative rotation control mechanism B. The aforementioned fluctuation torque is applied to the camshaft 10 of the internal combustion engine and the rotor 21. Because the operation fluid is not supplied to the advance angle chamber R1 and the retarded angle chamber R2, the rotation of the rotor 21 in the advance angle direction and in the retarded angle direction is restricted by the relative rotation control mechanism B, more particularly, restricted by the lock plate 61 engaged with the lock groove 21*h*. By the rotational force of the rotor 21, the lock groove 21*h* provided on the rotor 21 forces to rotate the lock plate 61 engaged with the lock groove 21*h*. The lock plate 61 transmits the rotational force from the rotor 21 to the housing 30 (i.e., shoe portion 31*j*) via the retraction bore 31*l*. That is, the force for rotating the rotor 21 by the fluctuation torque is applied to the shoe portion 31*j* provided with the retraction bore 31*l* of the housing 30 via the lock plate 61. Because the bolts 34 are provided on the portion 31*j*1 and the portion 31*j*2 of the shoe portion 31*j* respectively according to this embodiment, the portion 31*j*1 and the portion 31*j*2 is included in a U-shaped section (i.e., when viewed from the cross-section) which is formed by being sandwiched by the front plate 32 and the rear plate 33. The movement of the shoe portion 31*j* is restricted in the peripheral direction by the housing, the front plate 32, and the rear plate 33 fixed with the bolt 34 not to change the shape even at the relative rotation of the rotor 21 relative to the hosing 30. Thus, the rigidity of the portion 31$j$1 and the portion 31$j$2 is improved for preventing the displacement of the portion 31$j$1 and the portion 31$j$2 by the fluctuation torque. In addition, because the retraction bore 31$l$ and the accommodation portion 31$m$ are provided on the shoe portion 31$j$ and respective bolts 34 are respectively positioned on the portions 31$j$1 and the 31$j$2 which are approximately separate portions, the rigidity of the portions 31$j$1 and 31$j$2 can be improved. Accordingly, because the concentration of the stress to the peripheral portion 31$n$ of the housing body 31 is mitigated, the generation of the defect such as the generation of the crack on the housing 30 due to the fluctuation torque can be prevented.

Figure 4:
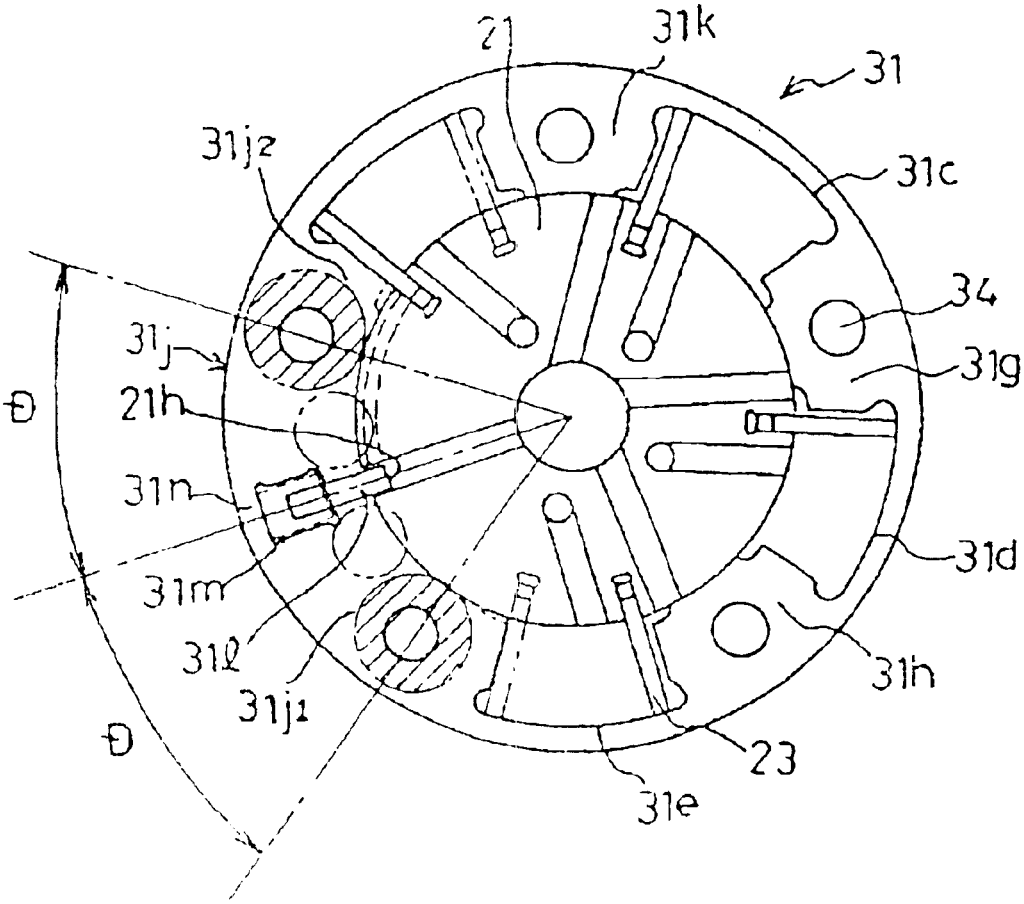
FIG. 4 is a view showing a second embodiment of a variable valve timing control device of the present invention.

FIG. 4 shows a second embodiment of a variable valve timing control device. The variable valve timing control device of the second embodiment is the same with the variable valve timing control device according to the first embodiment except the positioning of the bolts 34 to the housing 30. Thus, The explanation will be omitted by applying the same numerals with the first embodiment to the same construction with the first embodiment.

As shown in FIG. 4, the bolts 34 provided on the portions 31$j$1 and 31$j$2 of the shoe portion 31$j$ according to the second embodiment have an angle D relative to the retraction bore 31$l$ respectively. Thus, the circumferential length of the portion 31$j$1 and the circumferential length of the portion 31$j$2 of the shoe portion 31$j$ can be formed in approximately the same length. Accordingly, the rigidity of the portions 31$j$1 and 31$j$2 of the shoe portion 31$j$ can be approximately the same to ensure the strength of the portions 31$j$1 and 31$j$2. In addition, because the dimension of the shoe portion 31$j$ fastened with one bolt 34 is approximately the same with the dimension of the shoe portions 31$g$, 31$h$, 31$k$, the sealing effect between the fluid pressure chambers 31$c$, 31$d$, 31$e$, 31$f$ can be further improved. The shoe portions 31$g$, 31$h$, 31$k$, 31$j$ including the portions 31$j$1, 31$j$2 are functioning as the bearing of the rotor 21. The circumferential length of the portion 31$j$1 and the portion 31$j$2, and the length of the shoe portions 31$g$, 31$h$, 31$k$, can be approximately the same. Thus, because the rotor 21 evenly contacts the shoe portion functioning as the bearing, the life duration of the bearing is improved and the partial wear-out of the rotor 21 can be prevented. Further, by equalizing the bearing load, the rotor 21 is easily slidable and the sliding resistance can be reduced.

Figure 5:
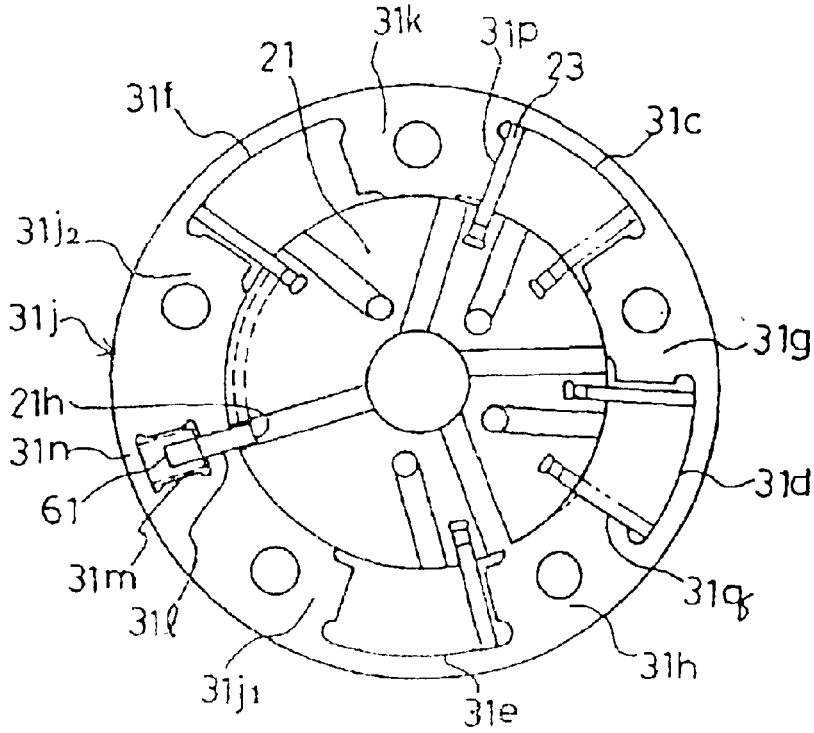
FIG. 5 is a view showing a third embodiment of a variable valve timing control device of the present invention.
Figure 6:
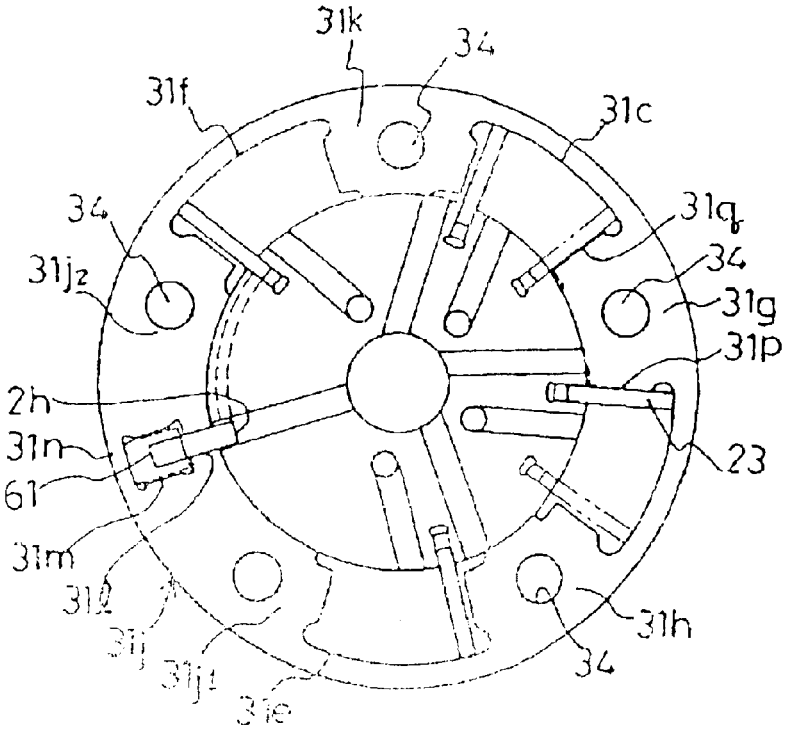
FIG. 6 is a view showing a variation of the third embodiment of the variable valve timing control device of the present invention.

FIGS. 5–6 show a third embodiment of a variable valve timing control device. The variable valve timing control device of the third embodiment is the same with the variable valve timing control device of the second embodiment except the positioning of the projections 31$p$, 31$q$. The same numerals are provided on the same construction with the second embodiment and the explanation is omitted.

As shown in FIG. 5, the vane 23 contacts the projection 31$p$ provided on one peripheral end surface of the shoe portion 31$k$ side in the first fluid pressure chamber 31$c$ when the relative phase position of the rotor 21 relative to the housing 30 is at tile most retarded angle position (i.e., the condition that the relative rotation between the rotor 21 and the housing 30 is restricted by the relative rotation control mechanism B). As shown with chain double-dashed lines in FIG. 5, the vane 23 contacts the projection 31$q$ provided on one peripheral end surface of the shoe portion 31$h$ side in the second fluid pressure chamber 31$d$ when the relative phase position of the rotor 21 relative to the housing 30 is at the most advance angle position.

As shown in FIG. 6, the vane 23 contacts the projection 31$p$ provided on one peripheral end surface of the shoe portion 31$g$ side in the second fluid pressure chamber 31$d$ when the relative phase position of the rotor 21 relative to the housing 30 is at the most retarded angle position (i.e., the condition that the relative rotation between the rotor 21 and the housing 30 is restricted by the relative rotation control mechanism B). As shown with chain double-dashed lines in FIG. 6, the vane 23 contacts the projection 31$q$ provided on the other peripheral end surface of the shoe portion 31$g$ side in the first fluid pressure chamber 31$c$ when the relative phase position of the rotor 21 relative to the housing 30 is at the most advance angle position.

According to the foregoing embodiments of the variable valve timing control device, the projections 31$p$, 31$q$ for restricting the relative rotation of the rotor 21 and the housing 30 by the contact of the vane 23 to the housing 30 when the relative rotation of the rotor 21 and the housing 30 is restricted by the relative rotation control mechanism B are provided in the fluid pressure chambers divided with the shoe portions 31$g$, 31$h$, 31$k$ which are not provided with the retraction bore 31$l$. Thus, the concentration of the load generated by the fluctuation torque, which is applied from the vane 23 to the housing 30, to a single shoe portion can be prevented. Thus, the rigidity of the housing 30 can be improved.

According to the embodiments of the present invention, the rigidity of the shoe portion provided with the engagement groove or the accommodation groove of the relative rotation control mechanism can be improved by providing the fixing members between one of the fluid pressure chambers divided by the shoe portion and the relative rotation control mechanism and another fixing member is provided between the relative rotation control mechanism and another fluid pressure chamber respectively. Thus, because the rigidity of the position on which the stress is concentrated is improved, the durability of the housing can be improved.

According to the embodiments of the present invention, by positioning tile fixing member having an equal angle relative to the rotational center of the housing the fastening force of the plate member fastened to the housing can be equalized. Thus, the sealing effect of the fluid pressure chamber in axial direction can be improved.

According to the embodiments of the present invention, by positioning the fixing members between one of the fluid pressure chambers divided by the shoe portion and the relative rotation control mechanism and another fixing member is provided between the relative rotation control mechanism and another fluid pressure chamber respectively having an equal angle relative to the relative rotation control mechanism, the length of the circumferential length of the portions of the shoe portion provided with the engagement groove or the accommodation groove can be approximately the same each other. Thus, because the dimension to be fastened with the fixing member is approximately the same with other shoe portions which are not provided with the relative rotation control mechanism and the sealing effect in axial direction between the fluid pressure chambers can be improved.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and change may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A variable valve timing control device comprising:

a housing unitarily rotatable either one of a crankshaft or a camshaft of an internal combustion engine;

a rotor unitarily rotatable with the other of the crankshaft or the camshaft of the internal combustion engine;

a first shoe portion positioned between first and second fluid pressure chambers provided between the housing and the rotor in a circumferential direction of the housing, the first fluid pressure chamber being located at one circumferential side of the first shoe portion and the second fluid pressure chamber being located at an opposite circumferential side of the first shoe portion;

a plate member for closing at least one axial end surface of the housing;

plural fixing members for unitarily fixing the housing and the plate member;

each of the first and second fluid pressure chambers being divided into an advance angle chamber and a retarded angle chamber by a respective vane;

a relative rotation control mechanism including a lock plate movable in a radial direction of the housing and a retraction groove provided at the first shoe portion for permitting movement of the lock plate in the radial direction, the retraction groove opening on both sides in a central axial direction of the housing and on a sliding surface of the shoe portion facing the rotor, and relative rotation between the housing and the rotor being restricted by engagement of the lock plate with an engagement groove provided on the rotor in accordance with a supply of fluid;

wherein one of the fixing members is provided between the first fluid pressure chamber and the retraction groove and another of the fixing member members is provided between the retraction groove and the second fluid pressure chamber.

2. A variable valve timing control device according to claim 1, further comprising second, third and fourth shoe portions, the first, second, third and fourth shoe portions forming a total of four circumferentially spaced apart fluid pressure chambers between the rotor and the housing.

3. A variable valve timing control device according to claim 2, wherein each of the fluid pressure chambers is provided with a vane dividing the fluid pressure chamber into an advance angle chamber and a retarded angle chamber, at least one of the vanes contacting one of the shoe portions not provided with a retraction groove.

4. A variable valve timing control device according to claim 3, wherein each of the plural fixing members is positioned at equal angle intervals with respect to adjacent fixing members relative to a rotational center of the housing.

5. A variable valve timing control device according to claim 1, wherein at least one of the respective vanes contacts at least said first shoe portion provided with the retraction groove.

6. A variable valve timing control device according to claim 1, wherein the relative rotation control mechanism includes a plurality of relative rotation control mechanism.

7. A variable valve timing control device according to claim 1, wherein the plate member comprises a front plate and a rear plate.

8. A variable valve timing control device according to claim 1, wherein each of the fixing members is positioned at equal angular intervals with respect to adjacent fixing members relative to a rotation center of the housing.

9. A variable valve timing control device according to claim 8, wherein said one of the fixing members provided between said first fluid pressure chamber and said retraction groove and said another of the fixing members provided between the retraction groove and the second fluid pressure chamber are positioned at equal angular intervals relative to the retraction groove.

10. A variable valve timing control device according to claim 1, wherein said one of the fixing members provided between said first fluid pressure chamber and said retraction groove and said another of the fixing members provided between the retraction groove and the second fluid pressure chamber are positioned at equal angular intervals relative to the retraction groove.

11. A variable valve timing control device according to claim 1, further comprising a second shoe portion, the first and second shoe portions at least partially forming two of the circumferentially spaced apart fluid pressure chambers between the rotor and the housing.

12. A variable valve timing control device according to claim 11, wherein the vane in one of the fluid pressure chambers contacts the second shoe portion which is not provided with the retraction groove.

13. A variable valve timing control device according to claim 12, wherein each of the fixing members is positioned at equal angular intervals with respect to adjacent fixing members relative to a rotation center of the housing.

14. A variable valve timing control device comprising:

a housing unitarily rotatable with either one of a crankshaft or a camshaft of an internal combustion engine;

a rotor unitarily rotatable with the other of the crankshaft or the camshaft of the internal combustion engine;

a first shoe portion positioned between first and second fluid pressure chambers provided between the housing and the rotor in a circumferential direction of the housing, the first fluid pressure chamber being located at one circumferential side of the first shoe portion and the second fluid pressure chamber being located at an opposite circumferential side of the first shoe portion;

a plate for closing at least one axial end surface of the housing;

a plurality of bolts fixing the housing and the plate;

each of the first and second fluid pressure chambers being divided into an advance angle chamber and a retarded angle chamber by a respective vane;

a relative rotation control mechanism including a lock plate movable in a radial direction of the housing and a retraction groove provided at the first shoe portion which receives the lock plate, the retraction groove opening on both sides in a central axial direction of the housing and on a sliding surface of the shoe portion facing the rotor, and relative rotation between the housing and the rotor being restricted by engagement of the lock plate with an engagement groove provided on the rotor in accordance with a supply of fluid;

wherein one of the bolts is provided between the first fluid pressure chamber and the retraction groove and another of the bolts is provided between the retraction groove and the second fluid pressure chamber.

* * * * *